US005636881A

United States Patent [19]

Stillwagon

[11] Patent Number: 5,636,881

[45] Date of Patent: Jun. 10, 1997

[54] AUTOMATIC LATCHING SYSTEM WITH AUTOMATED UNLATCHING FEATURE

[75] Inventor: Woodrow C. Stillwagon, Atlanta, Ga.

[73] Assignee: Star Lock Systems, Inc., Hilliard, Ohio

[21] Appl. No.: 327,376

[22] Filed: Oct. 21, 1994

[51] Int. Cl.[6] ..... E05C 1/04

[52] U.S. Cl. ..... 292/150; 292/146

[58] Field of Search ..... 292/144, 146, 292/150, 341.15, 341.16, 156; 70/229, 230

[56] References Cited

U.S. PATENT DOCUMENTS

| | | | |
|---|---|---|---|
| 1,262,435 | 4/1918 | Berg | 292/341.16 |
| 1,274,381 | 8/1918 | Brooks | 292/341.16 |
| 1,284,581 | 11/1918 | Bullock | 70/229 |
| 1,592,696 | 7/1926 | Heyer | 70/34 |
| 1,967,627 | 7/1934 | Riley et al. | 292/340 |
| 2,727,772 | 12/1955 | Hamilton | 292/341.15 |
| 3,753,316 | 8/1973 | Savarieau | 292/144 |
| 3,919,869 | 11/1975 | Fromm | 292/341.16 |
| 4,070,048 | 1/1978 | Young | 292/179 |
| 4,438,962 | 3/1984 | Soloviff | 292/144 |
| 4,796,930 | 1/1989 | Baynes | 292/58 |
| 4,819,983 | 4/1989 | Alexander | 292/341.16 |
| 4,900,182 | 2/1990 | Stillwagon | 463/325 |
| 4,974,888 | 12/1990 | Childers | 292/251 |
| 4,993,247 | 2/1991 | Minemura | 70/208 |
| 5,066,056 | 11/1991 | Schap | 292/341.16 |
| 5,186,516 | 2/1993 | Alexander | 292/341.15 |
| 5,197,314 | 3/1993 | Stillwagon et al. | 70/386 |
| 5,269,161 | 12/1993 | Stillwagon et al. | 70/34 |

*Primary Examiner*—Steven N. Meyers
*Assistant Examiner*—Gary Estremsky
*Attorney, Agent, or Firm*—Isaf, Vaughan & Kerr

[57] ABSTRACT

A latch housing defines an axial passage accessible at opposite ends thereof. Latch elements are radially displaced about the axis of the axial passage. A solenoid is mounted to an end of the latch housing and a post is inserted axially into the opposite end of the axial passage. The latch elements are biased to constrict around and preclude withdrawal of the post from the axial passage. An armature of the solenoid extends into the axial passage and a disengagement plate is attached to that end of the armature. As the post is inserted into the axial passage, a slot in the post mates with the disengagement plate, and the terminus of the slot contacts the disengagement plate causing the disengagement plate to translate along the axial passage with the post. The biased nature of the latch elements cause the latch elements to apply force to cam edges of the disengagement plate such that the disengagement plate translates away from the latch elements and post toward a coil of the solenoid so that the solenoid becomes fully armed. The solenoid provides motive force for driving the disengagement plate between the latch elements to cause the latch elements to move away from and thereby release their constricting grip upon the post. More specifically, when the solenoid is actuated the disengagement plate passes into the slot defined in the post and the disengagement plate contacts and drives the latch elements radially away from the post to effect an unlatching.

29 Claims, 10 Drawing Sheets

AUTOMATIC LATCHING SYSTEM WITH AUTOMATED UNLATCHING FEATURE

BACKGROUND OF THE INVENTION

The present invention relates generally to the field of latching devices and, in its most preferred embodiments, to the field of door latching devices.

A latching device holds lids, doors, and other closure pieces in a closed position on related boxes, cabinets, vending machines, doorways and other framed structures. There are numerous latching devices available, yet there is always a desire for improved latching devices that are capable of meeting the needs of high security areas as well as providing quick latching and unlatching. Some of the various latching devices that provide high security and quick latching are disclosed in U.S. Pat. Nos. 5,269,161; 4,974,888; 4,993,247; and 5,197,314. Those devices can be characterized as automatic latching systems that include a latching assembly and a post. In certain configurations, latching is automatically effected when the post is inserted into the latching assembly. The latching assemblies can be generally characterized as including a latch housing to which latch elements are movably attached. The latch housing includes opposite ends and defines an axial passage that is accessible at one of the ends of the latch housing. The latch elements are radially displaced about the axis of the axial passage and an end of the post is inserted axially into the axial passage. The latch elements move radially away from the axis of the axial passage when contacted by the post during the insertion of the post, whereby insertion of the post into the axial passage is facilitated. The latch elements then, due to their biased nature and contact with the surface of the post, constrict around the post to grip it and preclude withdrawal of the post from the axial passage.

In the aforementioned automatic latching systems, withdrawal of the post is generally facilitated by rotating the post. The post, often in conjunction with a T-handle, is rotated angularly about the post's elongated axis. Certain of the latching systems require the post to be rotated through a plurality of revolutions, whereas other of the latching systems require the post to be rotated only a quarter of a turn. Nonetheless, such manual labor is time consuming and wastes precious time. Such wasting of time can be very burdensome, for example, for a company that has a large number of vending machines that need to be serviced.

Also, because the aforementioned automatic latching systems are manually operated, their placement is generally limited to those places where the latching systems can be readily reached and operated. Thus, certain hard to reach portions of high security areas are often not protected and therefore targeted by thieves. Additionally, each of the aforementioned latching systems utilize key locks. Unfortunately, if the key to a key lock falls into the "wrong hands", the lock has to be "re-keyed" to maintain controlled access to the associated security area. Such re-keying can be very burdensome, for example, for a company that services a large number of vending machines.

There is, therefore, a need for improved latching systems and methods which address these and other related, and unrelated, problems.

SUMMARY OF THE INVENTION

Briefly described, the present invention includes an apparatus and method for effecting automatic unlatching of latching systems. More particularly, the present invention includes a method and apparatus for automatically unlatching automatic latching systems, wherein the unlatching is facilitated by moving the latch elements away from the post independent of any movement of the post. In accordance with the preferred embodiments of the present invention, the latch elements are forced away from the post by forcing an insert member between the latch elements and the post.

The latching systems of the preferred embodiments of the present invention have some similarity to, but are not limited to, the automatic latching systems described above. However, in accordance with the preferred embodiments of the present invention, the post is rigidly mounted to a closure piece and the latching assembly includes an automatic disconnect feature. The automatic disconnect feature preferably includes an electric solenoid mounted to the end of the latch housing that is opposite from the end into which the post is inserted. The armature of the solenoid extends into the axial passage defined in the latch housing and a disengagement plate is attached to the end of the armature that is within the axial passage. When the solenoid is actuated, it forces the disengagement plate between the latch elements and the post, whereby the disengagement plate functions as the insert member. Prior to actuation of the solenoid, the solenoid is preferably in an armed configuration; therefore, when the solenoid is actuated the armature travels its full stroke. When the solenoid is in the armed configuration, the disengagement plate is in an armed position at which the disengagement plate is at its closest distance to the coil of the solenoid. When the solenoid is actuated, the armature and the disengagement plate are translated along the axis of the axial passage toward the end of the post that is constricted within the axial passage, and the disengagement plate forces the latch elements away from the post. More specifically, the end of the post preferably defines a slot for receiving the disengagement plate, and the disengagement plate passes into the slot and contacts the latch elements to force them radially away from the post, thereby effecting an unlatching of the post. The disengagement plate preferably further contacts the terminus of the slot with enough force to force the post from the latch element.

In accordance with the preferred embodiments, after the solenoid has been actuated, the disengagement plate is in an actuated position such that it is at its farthest distance from the coil of the solenoid and interposed between the latch elements. The solenoid preferably does not have a spring return feature such that once the post has been unlatched from the latch housing, the disengagement plate remains in the actuated position. The solenoid is uniquely returned to its armed configuration by virtue of unique cooperation between the disengagement plate, the post, and the latch elements. More specifically, when the post is inserted back into the axial passage, the slot in the post mates with the disengagement plate, and the terminus of the slot contacts the disengagement plate causing the disengagement plate to translate along the axial passage with the post. As the disengagement plate translates and slides with respect to the latch elements, the latching elements come into contact with cam edges defined on the disengagement plate. The biased nature of the latch elements cause the latch elements to apply force to the cam edges and constrict around the post. The force applied on the cam edges causes the disengagement plate to be forced out of the slot in the post. Additionally, the force imparted on the cam edges of the disengagement plate is sufficient to cause the disengagement plate to translate toward the coil of the solenoid such that the solenoid returns to the armed configuration, whereby the disengagement plate is returned to the armed position. Due to the fact that the solenoid is not returned to its armed position under the force of a conventional spring return mechanism, the force of such a conventional spring does not have to be overcome when the solenoid is actuated.

In accordance with the preferred embodiments of the present invention, operation of the solenoid is controlled by operating a contact that is in electrical communication with the solenoid. The contact is capable of interfacing with a variety of devices including, but not limited to, a push-button assembly, a T-handle, an electronic security switch lock, a logic circuit, or a transmitter and receiver. Due to the fact that unlatching is effected electronically rather than manually, the latching systems of the present invention can be variously placed, even in hard to access regions, to maintain the integrity of high security areas. Additionally, the electronics of the present invention can readily interface with electronic information gathering systems to enhance the monitoring of high security areas. Further, a plurality of the latching systems of the present invention are capable of being operated with a single contact as part of a multi-point latching system. More specifically, multiple latching systems, some of which are capable of being remotely located, are capable of being readily employed and operated in unison to optimally secure a high security area.

It is therefore an object of the present invention to provide a new latching method and apparatus.

Another object of the present invention is to automate the unlatching of latching systems.

Yet another object of the present invention is to provide quick access to high security areas.

Still another object of the present invention is to provide a latching system that, while automatically latching upon the closure of the container associated therewith, has an automatic unlatching capability.

Still another object of the present invention is to provide a multi-point latching system.

Still another object of the present invention is to effect the unlatching of remote latches in response to a single operator action.

Still another object of the present invention is to provide for more effective latching, unlatching, and locking of containers.

Still another object of the present invention is to minimize unauthorized access to containers.

Still another object of the present invention is to provide a secure and dependable latching system.

Still another object of the present invention is facilitate the monitoring or gathering of information related to the accessing of high security areas.

Other objects, features and advantages of the present invention will become apparent upon reading and understanding this specification, taken in conjunction with the accompanying drawings.

DETAILED DESCRIPTION OF THE PREFERRED EMBODIMENTS

Figure 1:
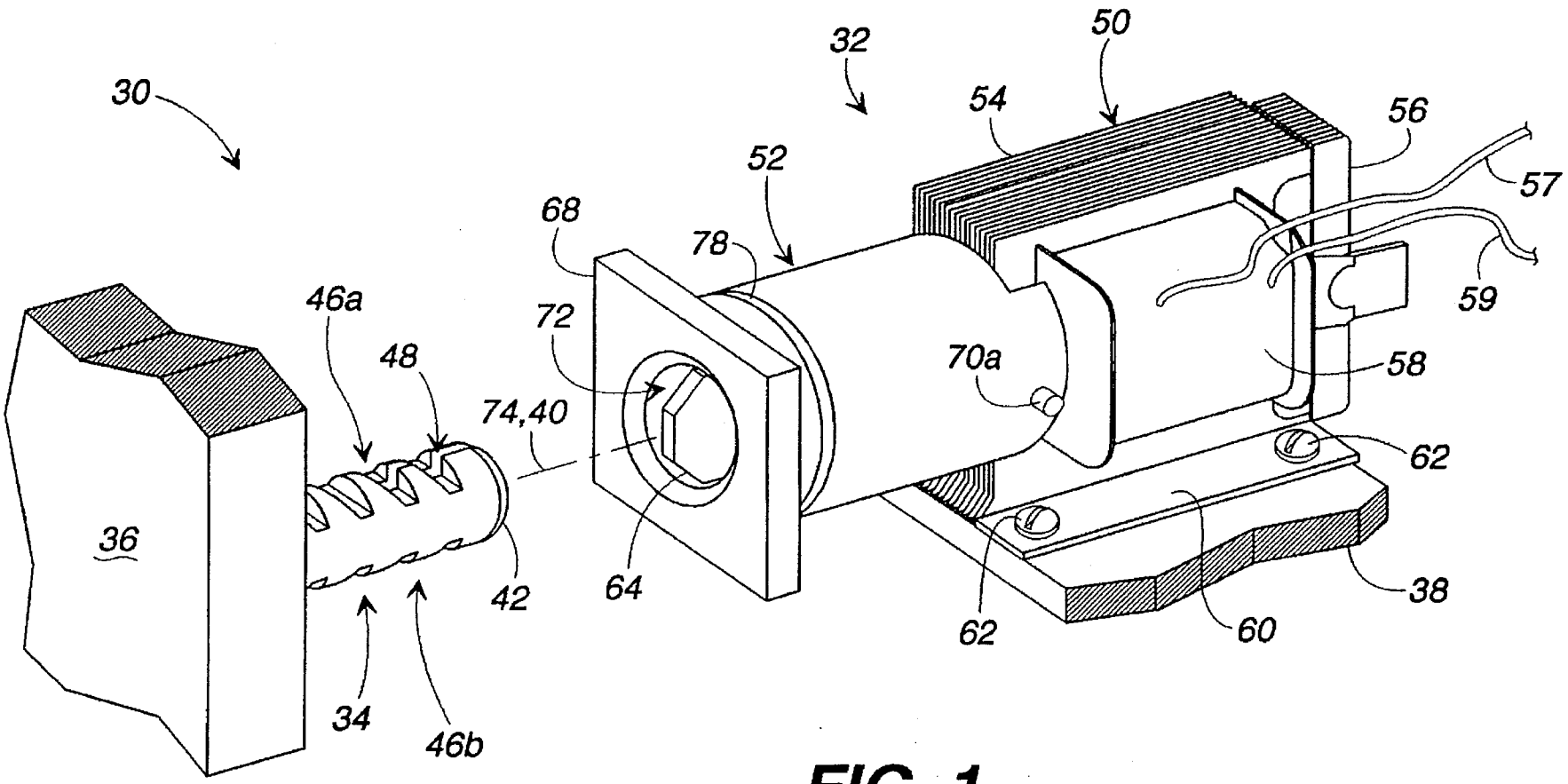
FIG. 1 is a perspective view of a latching system in accordance with a first preferred embodiment of the present invention, with latching components disconnected and supported by cut-away bodies such as, but not limited to, a vending machine door and a vending machine frame.

Referring now in greater detail to the drawings, in which like numerals represent like components thoroughout the several views, FIG. 1 is a perspective view of a latching system 30 in accordance with a first preferred embodiment of the present invention. The latching system 30 includes a latching assembly 32 for receiving and selectively latching to a post 34. The latching assembly 32 and post 34 are depicted in an unlatched configuration and are supported by cut-away bodies 36,38. The cut-away bodies 36,38 could be, but are not limited to, a vending machine door and a vending machine frame, respectively. The post 34 defines an elongated post axis 40 that extends in a direction defined between a front end 42 and an opposite rear end 44 (FIG. 14) of the post 34. The rear end 44 (FIG. 14) of the post 34 is preferably connected to the body 36 such that the post 34 is not capable of rotating angularly about the post axis 40. However, the post 34 is preferably capable of pivoting slightly with respect to the body 36. The pivoting seeks to aid in the insertion of the post 34 into a primary passage 72, as discussed in greater detail below. In accordance with the first preferred embodiment of the present invention, the post 34 defines two diametrically opposed gripping surfaces 46*a,b*. The gripping surfaces 46*a,b* are depicted as extending along the top and bottom, respectively, of the post 34 in FIG. 1. The post 34 further defines an aperture in the form of a rearward extending slot 48 that is accessible at the front end 42 of the post 34.

In accordance with the first preferred embodiment of the present invention, the latching assembly 32 includes a latch housing 52 that is connected to an electric solenoid assembly 50. The solenoid assembly 50 is, in accordance with the first preferred embodiment, of the alternating current type and includes a casing 54, an armature 56, and an electric magnet in the form of a coil 58. Electrical wires 57,59 are in electrical communication with and extend from the coil 58, as discussed in greater detail below. As will also be discussed in greater detail below, the solenoid assembly 50 preferably does not include a conventional spring return feature. As will additionally be discussed in greater detail below, a disengagement plate 64 is connected to and translates with the armature 56. In accordance with the first preferred embodiment, the front end of the latch housing 52 is in the form of a face plate 68, and the opposite or rear end of the latch housing 52 is connected to the solenoid assembly 50 by pins 70*a,b* (see also FIG. 2). A cylindrical primary passage 72 extends between the opposite ends of the latch housing 52 and defines a passage axis 74. As discussed in greater detail below, the disengagement plate 64 translates within the primary passage 72 along the passage axis 74. An annular groove 76 (FIG. 2) encircles the latch housing 52 and is occupied by biasing member in the form of an annular elastic band such as, but not limited to, an annular spring 78.

The solenoid assembly 50 is depicted as further including a base plate 60 that is rigidly affixed to the body 38 by, for example, mounting screws 62. However, in accordance with the preferred embodiments of the present invention, connection between the latching assembly 32 and the body 38 is not facilitated by the base plate 60 and mounting screws 62. Rather, in accordance with the preferred embodiments of the present invention, the latching assembly 32 is mounted to the body 38 by a flange (not shown). The flange is rigidly connected to the body 38 and the face plate 68 fits into the flange. The face plate 68 is capable of moving slightly with respect to the flange (i.e., the face plate 68 is capable of floating to a limited degree within the flange) to aid in the alignment of the post 34 with the cylindrical passage 72.

Figure 2:
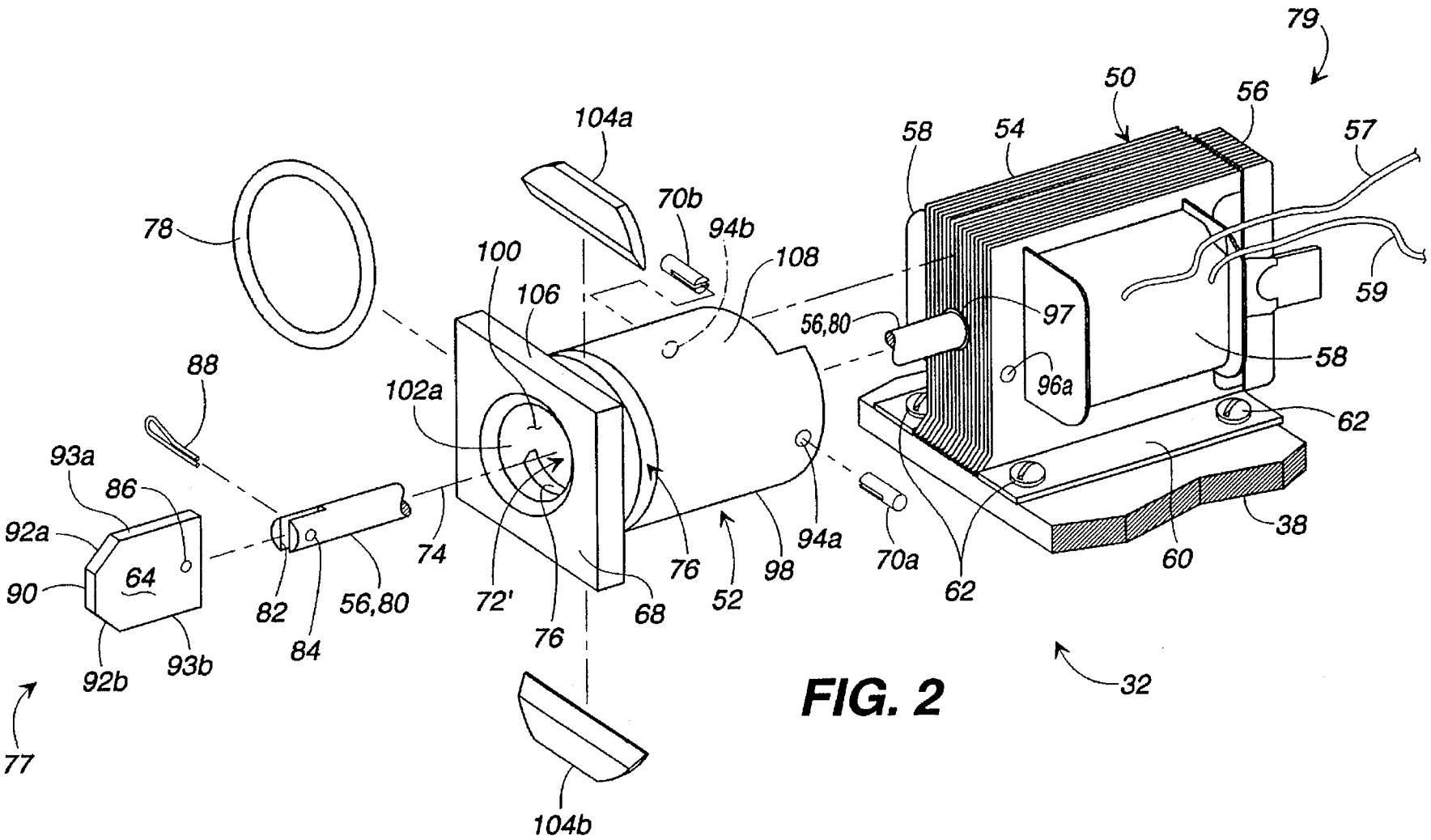
FIG. 2 is an isolated, perspective, exploded view of a latching assembly of the latching system of FIG. 1.

FIG. 2 is an isolated, perspective, exploded view of the latching assembly 32 of the latching system 30 (FIG. 1), in accordance with the first preferred embodiment of the present invention. The latching assembly 32 includes a front 77 and a rear 79. As mentioned previously, the pins 70*a,b* secure the solenoid assembly 50 to the latch housing 52. The pins 70*a,b* extend through mounting holes 94*a,b* defined through opposite sides of, and proximate to the rear of, the latch housing 52. The pins 70*a,b* extend from the mounting holes 94*a,b* into casing holes 96*a,b* (only one of which is shown) defined in the sides of the casing 54 of the solenoid assembly 50. The armature 56 of the solenoid assembly 50 extends through a guide hole 97 defined in the casing 54 in the form of a rod 80. The rod 80 is sectioned in FIG. 2 in an effort to clarify the view. The rod 80 extends collinearly with the passage axis 74 and is furcated at the end thereof that is distant from the casing 54. An aperture in the form of a slot 82 is defined at the terminus of and between the forks of the rod 80. A hole 84 is defined through each of the forks that define the slot 82 of the rod 80. The disengagement plate 64 includes a pivot hole 86 therethrough, a leading edge 90, opposite cam edges 92*a,b*, and trailing edges 93*a,b*. The disengagement plate 64 fits into the slot 82 such that the holes 84,86 align and a pivot pin 88, which is depicted in the form of a split cotter pin, is inserted through the holes 84,86 to connect the disengagement plate 64 to the rod 80. The disengagement plate 64 is preferably connected to the rod 80 such that the leading edge 90 is maintained generally perpendicular to the passage axis 74, but such that the disengagement plate 64 can pivot slightly with respect to the axis of the pivot pin 88.

The latch housing 52 includes an exterior surface 98 and an interior surface 100 that defines the primary passage 72. The annular groove 76 extends through the latch housing 52 such that the annular groove 76 is accessible at the exterior surface 98 and the interior surface 100 of the latch housing 52. While the annular groove 76 is accessible around the entire exterior surface 98, it not accessible around the entire interior surface 100. The interior surface 100 spans the annular groove 76 and thereby defines bridge members 102*a,b* (see also FIGS. 4, 5, and 7–9). The annular groove 76 figuratively separates the latch housing 52 into a forward portion 106 and a rearward portion 108 which are joined by the bridge members 102*a,b*. The latching assembly 32 further includes latch elements 104*a,b* which reside in the annular groove 76. The annular spring 78 fits into the annular groove 76 such that it encircles the passage axis 74 and biases the latch elements 104*a,b* toward the passage axis 74. As discussed in greater detail below, the latch elements 104*a,b* movably reside in the annular groove 76. The latch elements 104*a,b* move radially with respect to the passage axis 74 between an outward position and an inward position closer to the passage axis 74. More specifically, the latch elements 104*a,b* move at right angles to the passage axis 74 in accordance with the first preferred embodiment. Travel of the latch elements 104*a,b* is restricted between the outward and inward positions by the annular spring 78 and the bridge members 102*a,b*, respectively. The annular spring 78 is acceptably, but not limited to, an elongated coil spring having opposite ends of which have been joined to form a "hoop".

Figure 3:
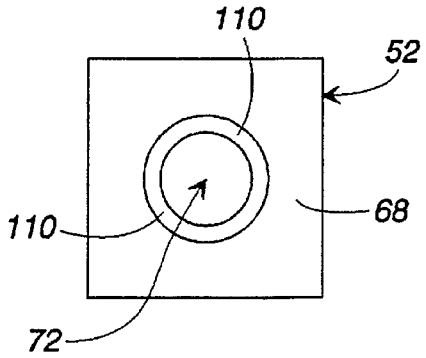
FIG. 3 is an isolated, front elevational view of a latch housing of the latching assembly of FIG. 2.
Figure 4:
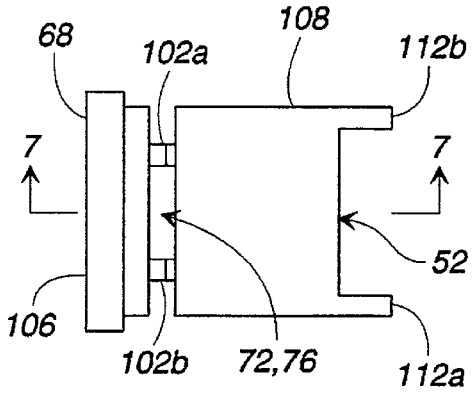
FIG. 4 is an isolated, top plan view of the latch housing, the side opposite being a mirror image.
Figure 5:
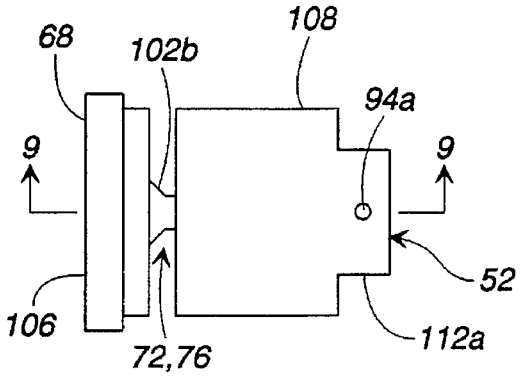
FIG. 5 is an isolated, side elevational view of the latch housing, the side opposite being a mirror image.
Figure 6:
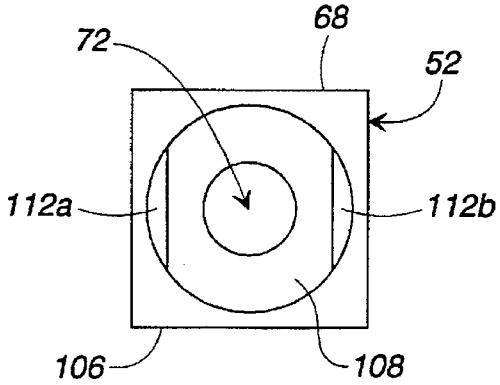
FIG. 6 is an isolated, rear elevational view of the latch housing.

FIG. 3 is an isolated, front elevational view of the latch housing 52, in accordance with the first preferred embodiment of the present invention. The face plate 68 defines an annular beveled surface 110 around the periphery of the entrance to primary passage 72. The beveled surface 110 seeks to facilitate easy entry of the front end 42 (FIG. 1) of the post 34 (FIG. 1) into the primary passage 72. FIG. 4 is an isolated, top plan view of the latch housing 52, the side opposite being a mirror image, in accordance with the first preferred embodiment of the present invention. The bridge members 102*a,b* are seen connecting the forward portion 106 of the latch housing 52 to the rearward portion 108 of the latch housing 52 in FIG. 4. The rearward portion 108 of the latch housing 52 is furcated to include extension members 112*a,b*. The extension members 112 straddle the forward most portion of the casing 54 (FIG. 2). Additionally, the mounting holes 94*a,b* (FIG. 2) are defined through the extension members 112*a,b* (also see FIG. 9). FIG. 5 is an isolated, right side, elevational view of the latch housing 52, the side opposite being a mirror image, in accordance with the first preferred embodiment of the present invention. FIG. 6 is an isolated, rear elevational view of the latch housing 52, in accordance with the first preferred embodiment of the present invention.

Figure 7:
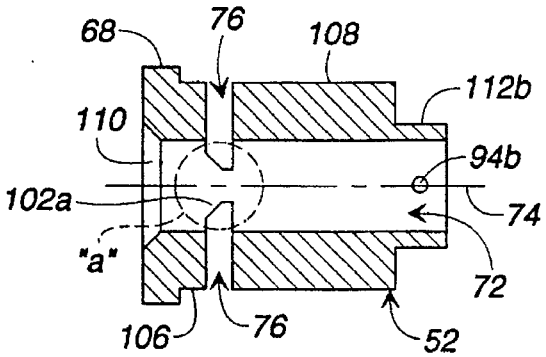
FIG. 7 is an isolated, cross-sectional view of the latch housing taken along line 7—7 of FIG. 4.
Figure 8:
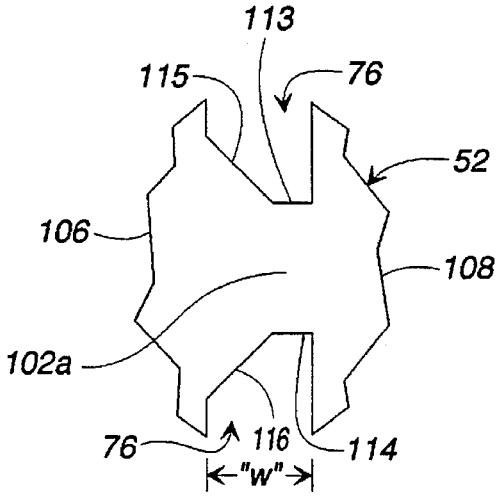
FIG. 8 is an enlarged, partial view of that portion of the latch housing that is encircled by line "a" of FIG. 7.
Figure 9:
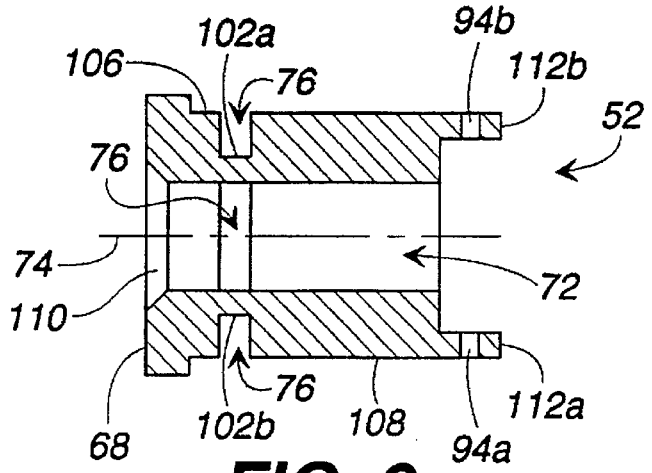
FIG. 9 is an isolated, cross-sectional view of the latch housing taken along line 9—9 of FIG. 5.

FIG. 7 is an isolated, cross-sectional view of the latch housing 52 taken along line 7—7 of FIG. 4, in accordance with the first preferred embodiment of the present invention. FIG. 8 is an enlarged, partial view of that portion of the latch housing 52 that is encircled by line "a" of FIG. 7. Thus, FIG. 8 includes an enlarged view of the bridge member 102*a*. Bridge member 102*a* is representative of bridge member 102*b* (FIGS. 4 and 5). Each bridge member 102*a,b* defines an upper root edge 113 and an opposite lower root edge 114, and an upper tapered edge 115 and an opposite lower tapered edge 116. The annular groove 76 defines a width "w" between the forward portion 106 and the rearward portion 108 of the latch housing 52. FIG. 9 is an isolated, cross-sectional view of the latch housing 52 taken along line 9—9 of FIG. 5, in accordance with the first preferred embodiment of the present invention. The mounting holes 94*a,b* are seen extending through the extension members 112*a,b* in FIG. 9.

Figure 10:
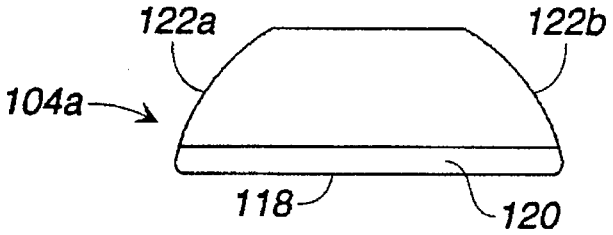
FIG. 10 is an isolated, front elevational view of a latch element of the latch assembly of FIG. 2.
Figure 11:
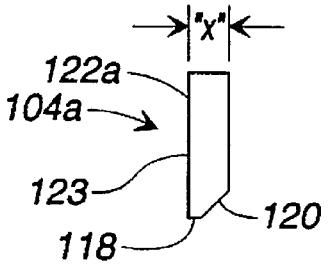
FIG. 11 is an isolated, left side, elevational view of the latch element.

FIG. 10 is an isolated, front elevational view of the latch element 104*a*, it being understood that the latch element 104*a* is representative of the latch element 104*b*, in accordance with the preferred embodiment of the present invention. FIG. 11 is an isolated, left side, elevational view of the latch element 104*a*, the side opposite being a mirror image, in accordance with the first preferred embodiment of the present invention. The latch element 104 includes a leading edge 118, a cam surface 120, opposite ends 122*a,b*, and a trailing edge 123 (FIG. 11). The latch element 104 further defines a thickness "x" (FIG. 11) that is slightly less that the width "w" (FIG. 8) of the annular groove 76 (FIGS. 2, 4, 5, and 7–9). Thus, the latch elements 104*a,b* are capable of traveling radially, with respect to the passage axis 74 (FIGS. 1, 2, 7, and 9), within the annular groove 76 (FIGS. 2, 4, 5, and 7–9) between an inward and an outward position. When the latch element 104*a* is in its most inward position, the leading edge 118 and the cam surface 120 proximate to the end 122*a* of the latch element 104*a* contact the upper root edge 113 (FIG. 8) and the upper tapered edge 115, respectively, of the bridge member 102*a* (FIGS. 2, 4, and 7–9); and the leading edge 118 and tapered edge 116 proximate to the end 122*b* of the latch element 104*a* contact the upper root edge 113 (FIG. 8) and upper tapered edge 115 (FIG. 8), respectively, of the bridge member 102*b* (FIGS. 4, 5, and 9). When the latch element 104*b* is in its most inward position, the leading edge 118 and the tapered edge 116 thereof, proximate to the ends 122*a,b* thereof, similarly mate with the lower root edges 114 (FIG. 8) and lower tapered edges 116 (FIG. 8), respectively, of the bridge members 102*a,b* (2, 4, 5, and 7–9), respectively.

Figure 12:
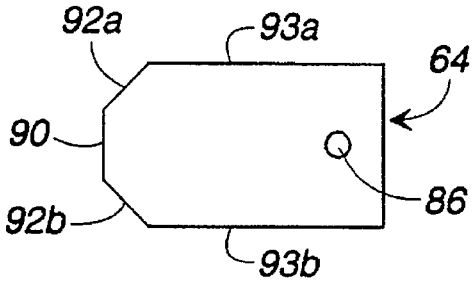
FIG. 12 is an isolated, side elevational view of a disengagement plate of the latching assembly of FIG. 2, the side opposite being a mirror image.
Figure 13:
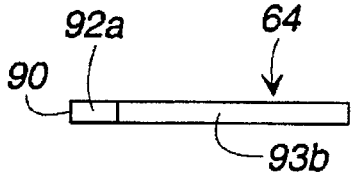
FIG. 13 is an isolated, top plan view of the disengagement plate, the side opposite being a mirror image.
Figure 14:
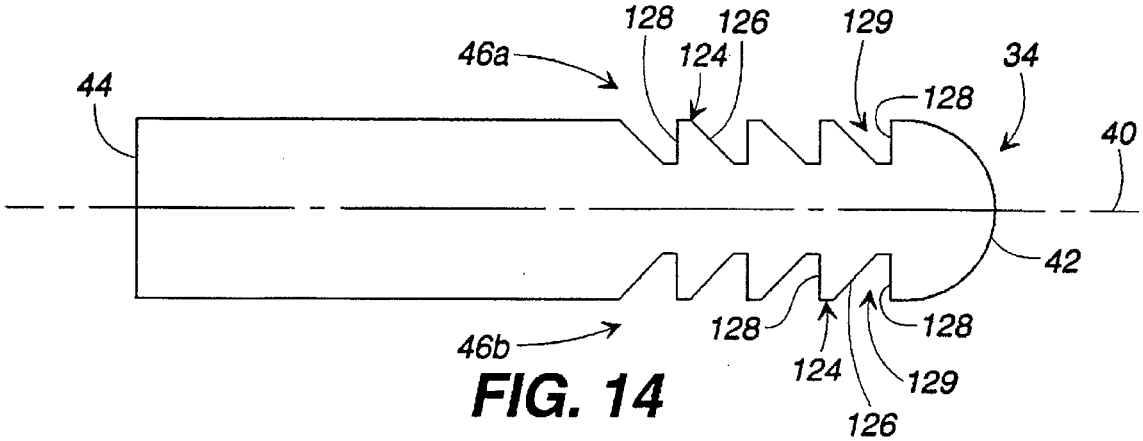
FIG. 14 is an isolated, side elevational view of a post of the latching system of FIG. 1.
Figure 15:
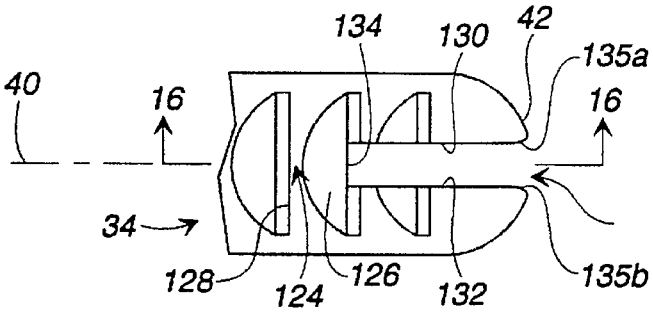
FIG. 15 is an isolated, cut-away, top plan view of the post.
Figure 16:
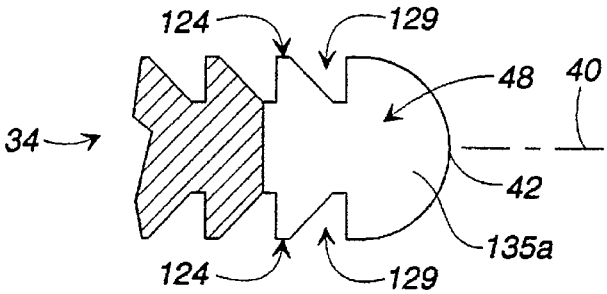
FIG. 16 is an isolated, cut-away, cross-sectional view of the post taken along line 16—16 of FIG. 15.

FIGS. 12 and 13 are isolated, right side, elevational and top plan views, respectively, of the disengagement plate 64 (see also FIGS. 1 and 2), in accordance with the first preferred embodiment of the present invention. FIG. 14 is an isolated, side elevational view of the post 34, in accordance with the first preferred embodiment of the present invention. The gripping surfaces 46 preferably define shapes such as, but not limited to, protrusions that seek to enhance the engagement of the latching elements 104 (FIGS. 2, 10, and 11) to the post 34, as discussed in greater detail below. In accordance with the first preferred embodiment of the present invention, each gripping surface 46 defines a plurality of ridges 124 which are formed with a rearwardly tapered leading surface 126 and a radially extending trailing surface 128. Further, the leading surfaces 126 and trailing surfaces 128 define valleys 129 therebetween. The front end 42 of the post 34 preferably defines a shape, such as a smooth and rounded shaped, which seeks to ease the entry of the front end 42 into the primary passage 72 (FIGS. 1–7). FIG. 15 is a cut-away, top plan view of the post 34 in accordance with the first preferred embodiment of the present invention. The slot 48 is seen defined between generally axially extending walls 130, 132 that extend between a radially extending wall 134 and the front end 42 of the post 34. In accordance with the first preferred embodiment of the present invention, the walls 130, 132 include entry portions 135*a,b* proximate to the front end 42. The entry portions 135*a,b* each define a radius of curvature such that the walls 130, 132 tend to curve away from the post axis 40 at the front end 42 of the post 34. The curvature of the entry portions 135*a,b* seeks to ease the entry of the disengagement plate 64 (FIGS. 1, 2, 12, and 13) into the slot 48, as discussed in greater detail below. FIG. 16 is an isolated, cut-away, cross-sectional view of the post 34 taken along line 16—16 of FIG. 15, in accordance with the first preferred embodiment of the present invention.

Figure 17:
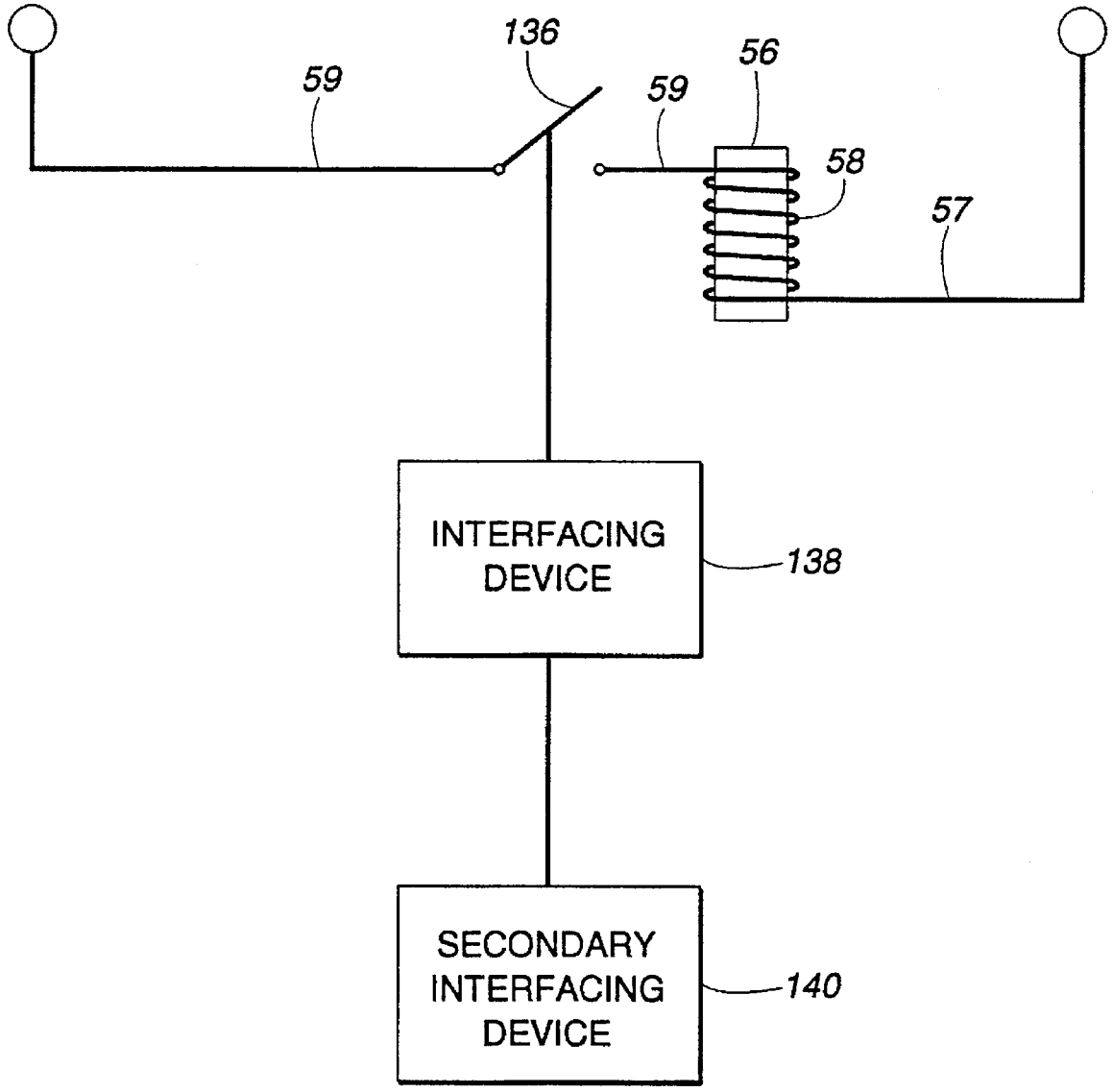
FIG. 17 is a schematic electrical diagram of the latching assembly in accordance with the first preferred embodiment of the present invention.

FIG. 17 is a schematic electrical diagram of the latching assembly 32 (FIGS. 1 and 2) in accordance with the first preferred embodiment of the present invention. As discussed previously, electrical wires 57, 59 are in electrical communication with and extend from the coil 58. A contact 136 is preferably interposed within the electrical wire 59 to control the energizing of the coil 58, whereby the contact 136 controls movement of the armature 56 and thereby the disengagement plate 64 (FIGS. 1, 2, 12 and 13). In accordance with the first preferred embodiment of the present invention, several coils 58 (i.e., solenoid assemblies 50 (FIGS. 1 and 2)) are capable of being electrically wired in series or parallel such that the unlatching (discussed below) of several latching systems 30 (FIG. 1) is capable of being controlled by a single contact 136. Thus, in accordance with the first preferred embodiment of the present invention, several latching systems 30 are incorporated into a multi-point latching system such that a plurality of latching systems 30 (FIG. 1) are positioned remotely from each other to latch a single body 36 (FIG. 1) to another single body 38 (FIG. 1); and a single contact 136 electrically communicates with each of the plurality of latching systems 30 (FIG. 1) such that the unlatching of each of the plurality of latching systems 30 is effected in unison.

The contact 136 is acceptably closed and opened by an associated interfacing device 138 such as, but not limited to, a push-button assembly (not shown) or an electronic security switch lock (not shown), wherein the interfacing device 138 functions to open and close the contact 136. Further, the interfacing device 138 is acceptably a device such as a logic circuit that operates the contact 136, for example, on given time intervals, or even functions with or as an electronic information gathering system to enhance the monitoring of high security areas. Another acceptable logic circuit operates in conjunction with a push-button assembly and operates the contact 136 upon the entry of a proper access code. Such a logic circuit is preferably capable of being conveniently reprogrammed, by one with proper authority, to selectively change the access code in an effort to assure controlled access to an associated high security area. Alternatively, the interfacing device 138 is acceptably, but not limited to, a receiver that cooperates with a secondary interfacing device 140 such as, but not limited to, a transmitter. An acceptable transmitter and receiver combination is, for example and not limitation, the transmitter and receiver associated with a remotely operated garage door.

Figure 18:
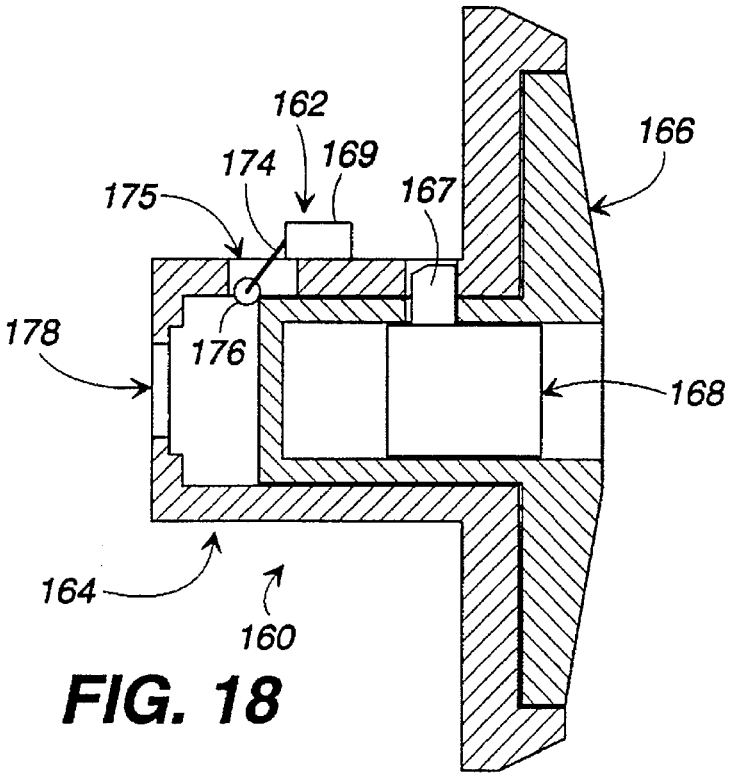
FIGS. 18 and 19 are cross-sectional side views of a T-handle assembly in a locked and unlocked configuration, respectively, wherein the T-handle assembly is equipped with a switch assembly, in accordance with an alternate embodiment of the present invention.
Figure 19:
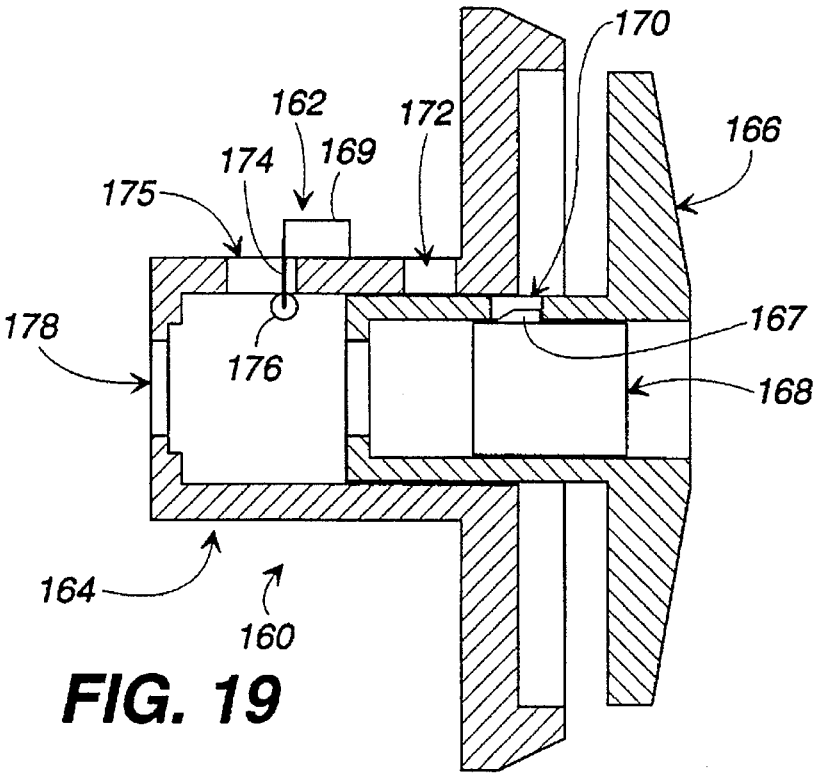

Alternatively, the contact 136 (FIG. 17) is mounted to a T-handle assembly 160 (FIGS. 18 and 19). A suitable T-handle assembly, once modified as disclosed herein, is disclosed in U.S. Pat. No. 5,272,894, which is expressly incorporated herein, in its entirety, by reference. For example, and not limitation, FIGS. 18 and 19 are cross-sectional side views of a T-handle assembly 160 equipped with a switch assembly 162 that houses the contact 136 (FIG. 17), in locked and unlocked configurations, respectively. The T-handle assembly includes a T-handle housing 164 into which a T-handle 166 is selectively nested. A lock assembly 168 is preferably disposed within the T-handle 166 and is not depicted as cross-sectioned in FIGS. 17 and 18. The lock assembly 168 includes a lock bolt 167 that selectively protrudes through a first bolt channel 170 (FIG. 19) defined in the T-handle 166 and a second bolt channel 172 (FIG. 19) defined in the T-handle housing 164 to facilitate locking and unlocking of the T-handle assembly 160 in a conventional manner, as should be understood by those reasonably skilled in the art. Unique is the cooperation of the switch assembly 162 with the T-handle assembly 160. In the depicted embodiment, the switch assembly 162 includes a switch housing 169 that houses the contact 136 (FIG. 17) therein, and the contact 136 is in electrical communication with the electrical wire 59 (FIG. 17). The contact 136 (FIG. 17) cooperates with and is opened and close by movement of a switch lever 174 that extends through a switch aperture 175 defined through the T-handle housing 164. The switch lever 174 has one end extending into the switch housing 169 and an opposite end to which a roller 176 is attached. The switch lever 174 is biased toward the configuration in which it is depicted in FIG. 19, and when the switch lever 174 is in that configuration it functions such that the contact 136 is open. When the T-handle 166 is forced into the T-handle housing 164 as depicted in FIG. 18, the roller 176 contacts and rolls up the terminus of the T-handle 166 such that the switch lever 174 is forced to pivot relative to the switch housing 169, and in such a pivoted configuration the switch lever 174 functions to close the contact 136.

In accordance with certain alternate embodiments, the T-handle assembly 160 is part of a T-handle operated latching system (not shown). The T-handle operated latching system further includes an elongated post (not shown) that extends through a hole 178 defined through the terminus of the T-handle housing 164. The elongated post cooperates and rotates with the T-handle 166 to effect latching and unlatching of the elongated post with a post latching assembly (not shown). The T-handle operated latching system preferably operates in unison with one or more latching systems 30 (FIG. 1) by virtue of the switch assembly 162, whereby the T-handle operated latching system and latching systems 30 are part of a multi-point latching system.

Figure 20:
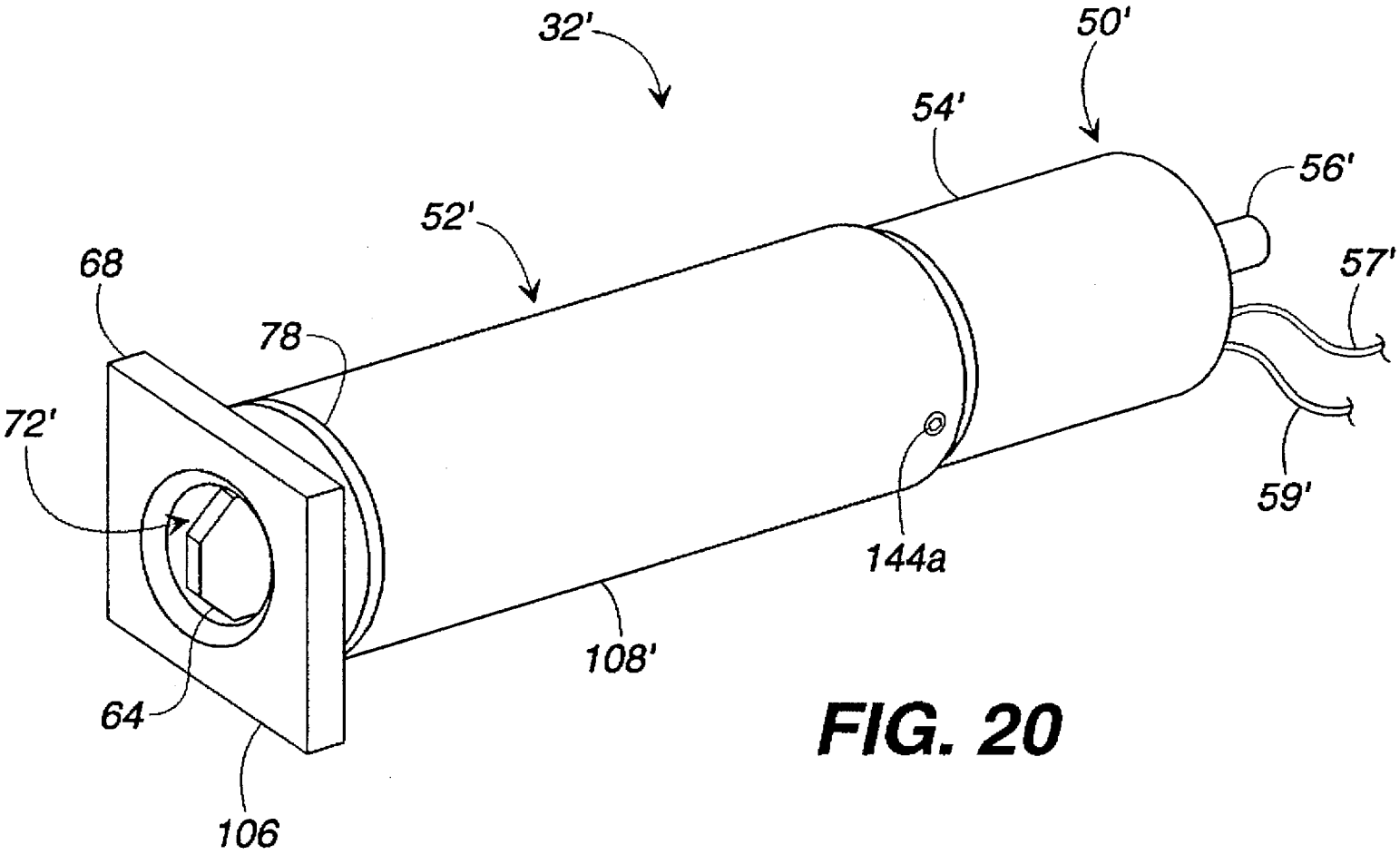
FIG. 20 is an isolated, perspective view of a latching assembly in accordance with a second preferred embodiment of the present invention.
Figure 21:
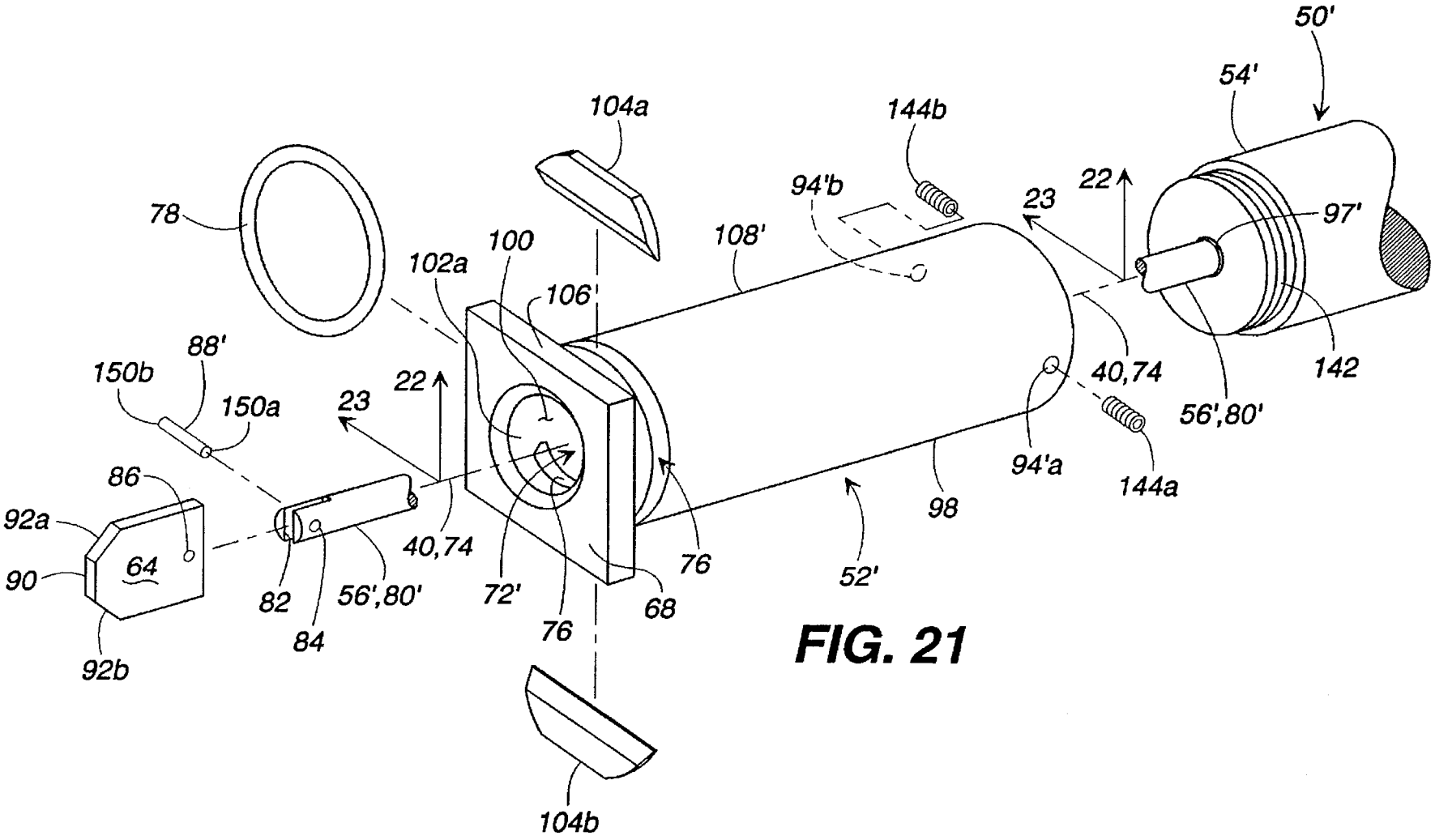
FIG. 21 is an isolated, perspective, partially cut-away, exploded view of the latching assembly of FIG. 20.

FIGS. 20 and 21 are isolated, perspective and isolated, perspective, partially cut-away, exploded views, respectively, of a latching assembly 32', in accordance with a second preferred embodiment of the present invention. Unless noted otherwise, the latching assembly 32' and all of its associated components are identical to the corresponding components of the first preferred embodiment. As discussed below, the differences are in the rearward portion 108' of the latch housing 52', the solenoid assembly 50', and the pivot pin 88' (FIG. 21). For example, the length of the rearward portion 108' of the latch housing 52' of the second preferred embodiment is greater than the length of the rearward portion 108 (FIGS. 1, 2, 4–9) of the latch housing 52 (FIGS. 1–9) of the first embodiment. Additionally, in accordance with the second preferred embodiment of the present invention, the solenoid assembly 50' is of the direct current type. Further, as depicted in FIG. 21, the casing 54' of the solenoid assembly 50' defines an annular threaded portion 142 at the front thereof. The threaded portion 142 threads into the primary passage 72' at the rear of the latch housing 52' to facilitate attachment between the latch housing 52' and the solenoid assembly 50'. The mounting holes **94'*a,b* (FIG. 21) are threaded and aid in the attachment between the latch housing 52' and the solenoid assembly 50' by virtue of the fact that screws 144*a,b* (FIG. 21) thread through the mounting holes 94'*a,b* and engage the solenoid assembly 50'**.

Figure 22:
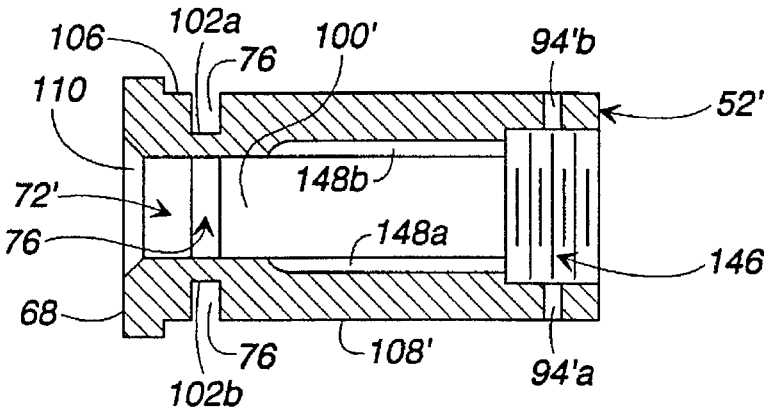
FIG. 22 is an isolated, cross-sectional view of a latch housing of the latch assembly taken along line 22—22 of FIG. 21.
Figure 23:
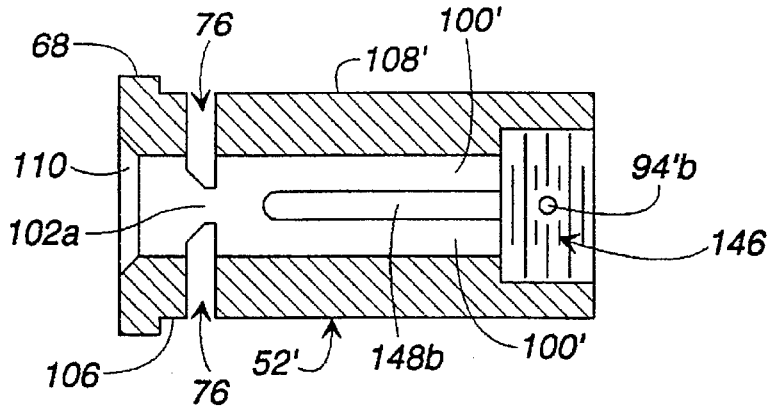
FIG. 23 is an isolated, cross-sectional view of the latch housing taken along line 23—23 of FIG. 21.

FIGS. 22 and 23 are isolated, cross-sectional views of the latch housing 52' taken along lines 22—22 and 23—23, respectively, of FIG. 21, in accordance with the second preferred embodiment of the present invention. As shown, the latch housing 52' does not include the extension members 112 (FIGS. 4–7). However, the interior surface 100' of the rearward portion 108' defines an annular threaded section 146 for threadedly receiving the threaded portion 142 (FIG. 21) of the solenoid assembly 50'. The interior surface 100' further defines axially extending slots **148*a,b*. Referring back to FIG. 21, the pivot pin 88' includes opposite ends 150*a,b* that extend radially from the rod 80' and protrude into the slots 148*a,b*, respectively. The pivot pin 88' and slots 148 cooperate to restrict the motion of the rod 80' to translational motion in the direction of the passage axis 74. That is, the slots 148 in combination with the pivot pin 88' seek to prevent angular rotation of the rod 80' about the passage axis 74 (FIG. 21). Referring back to FIG. 2, in accordance with the first preferred embodiment, such angular rotation of the rod 80 about the passage axis 74 is precluded due to the construction of the solenoid assembly 50**.

Referring back to FIG. 1, the latching system 30 is operated, in accordance with the first preferred embodiment of the present invention, to effect latching and unlatching between the bodies 36, 38. As depicted in FIG. 1, the latching system 30 is, of course, in an unlatched configuration. Further, and with additional reference to FIG. 2, when the latching system 30 is oriented as depicted in FIG. 1, the latching elements 104 are in their outward position (discussed previously) by virtue of the fact that the disengagement plate 64 is in an actuated position in which it is inserted between the latching elements **104*a,b*. When the disengagement plate 64 is in the inserted position (i.e., functioning as an insert member), the leading edges 118 (FIGS. 10 and 11) of the latching elements 104*a,b* are resting upon the trailing edges 93*a,b* (FIG. 2), respectively, of the disengagement plate 64. As oriented in FIG. 1, the latching system 30 is readied for latching by de-energizing the solenoid assembly 50 by opening the contact 136 (FIG. 17). Then, for example, the body 36 is moved such that the front end 42 of the post 34 is inserted into the primary passage 72 at the face plate 68 end of the latch housing 52. As mentioned previously, the post 34 is preferably immovably affixed to the body 36. Further, the post 34 is preferably affixed to the body 36 such that upon insertion of the post 34 into the primary passage 72, with the latching assembly 32 configured as shown in FIG. 1, the disengagement plate 64 enters into the slot 48 at the front end 42 of the post 34 such that the wall 134 (FIG. 15) at the rear of the slot 48 contacts the leading edge 90 of the disengagement plate 64**.

With reference to FIGS. 1 and 2, as the post 34 is inserted further into the primary passage 72, the post 34 forces the disengagement plate 64 to translate rearward toward the rearward portion 108 of the latch housing 52, whereby the trailing edges **93*a,b* of the disengagement plate 64 slidingly contact the leading edges 118 (FIGS. 10 and 11) of the latch elements 104*a,b*. As the post 34 pushes the disengagement plate 64 further rearward, the trailing edges 93 of the disengagement plate 64 pass to the rear of the leading edges 118 (FIGS. 10 and 11) of the latch elements 104***a,b*. By the time the trailing edges 93 have translated rearward of the leading edges 118, the post 34 is interposed between the latch elements 104*a,b* such that the leading edges 118 of the latching elements 104*a,b* engage the gripping surfaces 46*a, b,* respectively, to effect a latching between the post 34 and the latching assembly 32. More specifically, once the trailing edges 93 are rearward of the latching elements 104, the annular spring 78 functions to constrict the latch elements 104*a,b* into cooperation with the gripping surfaces 46 of the post 34 such that the post 34 is gripped in a manner that seeks to preclude withdrawal of the post 34 from the primary passage 72. In accordance with the preferred embodiment of the present invention, when the latching system 30 is in the latched or gripping configuration, the latch elements 104*a,b* are preferably in the previously discussed inward position, and the latch elements 104*a,b* reside in the valleys 129 (FIGS. 14 and 16) defined by the gripping surfaces 46*a,b,* respectively. More specifically, in accordance with the first preferred embodiment of the present invention, the latch element 104*a* occupies the valley 129 defined by the gripping surface 46*a* that is most proximate to the front end 42 of the post 34. Similarly, the latch element 104*b* occupies the valley 129 defined by the gripping surface 46*b* that is most proximate to the front end 42 of the post 34. This result is acceptably accomplished, for example, by limiting the distance that the post 34 is capable of being inserted into the primary passage 72. Insertion of the post 34 is acceptably limited, for example, by appropriately defining the length of the post 34 in light of the closing characteristics of the bodies 36, 38. A similar effect is more preferably achieved, however, by employing an alternate post 34' (not shown) that is identical to the post 34 except that the post 34' only defines two valleys 129. More specifically, a gripping surface 46*a'* (not shown) of the post 34' defines a single valley 129 proximate to the front end 42 of the post 34' for receiving the latch element 104*a,* and the post 34' is generally smooth and cylindrical rearward of the valley 129 defined by the gripping surface 46*a'*. Similarly, a gripping surface 46*b'* of the post 34' defines a single valley 129 proximate to the front end 42 of the post 34' for receiving the latch element 104*b,* and the post 34' is generally smooth and cylindrical rearward of the valley 129 defined by the gripping surface 46*b'*. In accordance with alternate embodiments of the present invention, the post 34 inserts further into the primary passage 72. More specifically, the cam surfaces 120 (FIGS. 10 and 11) of the latch elements 104*a,b* slidingly contact and cooperate with the leading surfaces 126 (FIGS. 14 and 15) of the latching surfaces 46*a,b,* respectively, to allow further insertion of the post 34 into the primary passage 72 such that the latch elements 104*a,b* latch into rearward valleys 129.

In accordance with the preferred embodiments of the present invention, once the trailing edges 93 are forced just rearward of the latching elements 104 due to the influence of the post 34, the annular spring 78, latch elements 104, and disengagement plate 64 inventively cooperate to return the solenoid assembly 50 to an armed configuration. More specifically, as the post 34 is being inserted into the primary passage 72, immediately after the trailing edges 93 have been urged rearward of the leading edges 118 (FIGS. 10 and 11) of the latch elements 104*a,b* by the insertion of the post 34, the leading edges 118 (FIGS. 10 and 11) and tapered edges 120 of the latch elements 104*a,b* are forced by the annular spring 78 to come into contact with the cam edges 92*a,b,* respectively, of the disengagement plate 64. The biased nature of the latch elements 104*a,b* cause the latch elements 104*a,b* to slidingly engage and apply force to the cam edges 92*a,b* such that the disengagement plate 64 is forced out of the slot 48 in the post 34 and propelled toward the coil 58 of the solenoid assembly 50 such that the solenoid assembly 50 returns to its armed configuration. In other words, the disengagement plate 64 is forced into an armed position in which it is at its closest distance to the coil 58 of the solenoid assembly 50. In this armed configuration, when the solenoid assembly 50 is subsequently actuated, the armature 56 of the solenoid assembly 50 moves through its full or maximum stroke, whereby the disengagement plate 64 is moved from its armed position to its actuated position. When the disengagement plate 64 is in the actuated position, it is at its farthest distance from the coil 58 of the solenoid assembly 50. Due to the fact that the solenoid assembly 50 is not returned to its armed position under the force of a conventional spring return mechanism, the force of such a conventional spring return mechanism does not have to be overcome when the solenoid assembly 50 is actuated.

In accordance with the first preferred embodiment of the present invention, unlatching is inventively effected by closing the contact 136 (FIG. 17) to actuate the solenoid assembly 50. Actuation of the solenoid assembly 50 causes the disengagement plate 64 to translate to its actuated position. In other words, upon actuation of the solenoid assembly 50, the disengagement plate 64 translates toward the body 36 along the passage axis 74 and into the slot 48 defined at the front end 42 of the post 34. As the disengagement plate 64 translates, the cam edges 92*a,b* of the disengagement plate 64 slidingly contact the leading edges 118 (FIGS. 10 and 11) and cam surfaces 120 (FIGS. 10 and 11) of the latch elements 104*a,b,* respectively, forcing the latch elements 104*a,b* toward their previously discussed outward position. As the disengagement plate 64 translates farther towards its actuated position, the trailing edges 93*a,b* of the disengagement plate 64 slidingly engage the leading edges 118 (FIGS. 10 and 11) of the latch elements 104*a,b,* respectively, whereby the latch elements 104*a,b* are oriented in the outward position. As soon as the latch elements 104*a,b* are in the outward position, the latch elements 104*a,b* are no longer within the valleys 129 (FIGS. 14 and 16), whereby the post 34 is no longer latched to the latching assembly 32. As the disengagement plate 64 translates completely to its actuated position, the leading edge 90 thereof preferably contacts the radially extending wall 134 (FIG. 15) of the post 34 and pushes the post 34 from the primary passage 72. Operation of the second preferred embodiment of the present invention is similar to the operation of the first preferred embodiment of the present invention, and should be understood by those reasonably skilled in the art in light of the foregoing.

Figure 24:
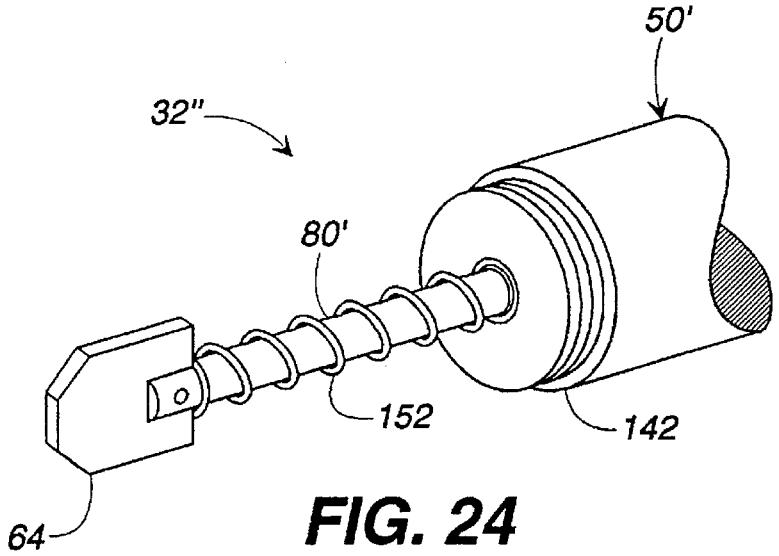
FIG. 24 is an isolated, perspective, partially cut-away view of portions of a latching assembly in accordance with an alternate embodiment of the present invention.

FIG. 24 is an isolated, perspective, partially cut-away view of portions of a latching assembly 32" in accordance with an alternate embodiment of the present invention. A coil spring 152 encircles the rod 80' and seeks to aid in the translation of the disengagement plate 64. Referring back to FIG. 1, in accordance with another alternate embodiment of the present invention, the post 34 is attached to the body 36 such that the post 34 is capable of being rotated angularly about the post axis 40 to effect latching and unlatching when the disengagement plate 64 is not disposed within the slot 48. Such rotation of the post 34 is acceptably accomplished through the employment of a T-handle assembly such as, but not limited to, the T-handle assembly disclosed in U.S. Pat. No. 5,272,894, which has been previously incorporated herein by reference.

While certain of the preferred and alternate embodiments of the present invention have been disclosed herein, other embodiments of the apparatus and methods of the present invention will suggest themselves to persons skilled in the art in view of this disclosure. Therefore, it will be understood that variations and modifications can be effected within the spirit and scope of the invention and that the scope of the present invention should only be limited by the claims below. Additionally, while it is intended that the scope of the present invention also include various alternate embodiments, it should be understood that each of the embodiments disclosed herein, including the preferred embodiments, include features and characteristics which are considered independently inventive. Accordingly, the disclosure of variations and alterations expressed in alternate embodiments is intended only to reflect on the breadth of the scope of the present invention without suggesting that any of the specific features and characteristics of the preferred embodiment are in any way obvious or unimportant.

I claim:

1. A latching apparatus comprising:

a post member defining a post axis;

a housing member defining a passage and a passage axis, wherein said passage receives said post member to define an inserted configuration;

a latch element movably connected to said housing member to engage and restrict withdrawal of said post member from said passage;

a disengagement member movably connected to said housing member for movement between a first position and a second position, wherein, when said disengagement member is in said first position and said post member is in said inserted configuration, said disengagement member is interposed between said latch element and said post member, whereby said latch element is disengaged from said post member; and a solenoid for moving said disengagement member.

2. The latching apparatus of claim 1, wherein said disengagement member is distant from said latch element when said disengagement member is in said second position.

3. The latching apparatus of claim 1, wherein said post member defines an aperture for receiving said disengagement member, and wherein said disengagement member is disposed, at least partially, within said aperture when said post member is in said inserted configuration and said disengagement member is in said first position.

4. The latching apparatus of claim 1, wherein the latching apparatus further comprises a spring, said spring defining a spring force biasing said latch element into contact with said disengagement member to force said disengagement member into said second position.

5. The latching apparatus of claim 1, wherein said latch element comprises a plurality of latch elements movably connected to said housing member and generally bounding said passage axis, wherein said plurality of latch elements are movable between an outward position and an inward position nearer said passage axis, wherein said plurality of latch elements are biased toward said inward position, and wherein said plurality of latch elements engage and restrict withdrawal of said post member from said passage when said post member is in said inserted configuration and said plurality of latch elements are in said inward position, and wherein said disengagement member is interposed between said plurality of latch elements and said post member when said disengagement member is in said first position and said post member is in said inserted configuration, whereby said plurality of latch elements are disengaged from said post member.

6. The latching apparatus of claim 5, wherein said post member defines an aperture for receiving said disengagement member, and wherein said disengagement member is disposed, at least partially, within said aperture when said post member is in said inserted configuration and said disengagement member is in said first position.

7. The latching apparatus of claim 5, wherein said plurality of latch elements are in said outward position when said disengagement member is in said first position.

8. The latching apparatus of claim 5, wherein said disengagement member contacts said plurality of latch elements in said first position.

9. The latching apparatus of claim 8, wherein said disengagement member is distant from said plurality of latch elements in said second position.

10. The latching apparatus of claim 5, wherein said housing member further defines a first end and a second end, wherein said post member is insertable into said passage at said first end, wherein said solenoid includes an electric magnet, and an armature movably associated with and extending from said electric magnet, wherein said armature extends into said passage in a direction defined from said second end to said first end, and wherein said disengagement member is connected to and moved by said armature.

11. The latching apparatus of claim 10, wherein when said electric magnet is energized, said armature forces said disengagement member into said first position.

12. A latching apparatus for latching a first body to a second body, the latching apparatus comprising:

a post member connected to the first body;

a housing member connected to the second body and defining a first end, a second end, a passage accessible at said first end for receiving said post member, and a passage axis;

a plurality of latch elements movably connected to said housing member, wherein said plurality of latch elements are movable between an outward position and an inward position nearer said passage axis, wherein said plurality of latch elements are biased toward said inward position, wherein said plurality of latch elements engage said post member when said post member is oriented within said passage and said plurality of latch elements are in said inward position to restrict axial movement of said post member in at least a first axial direction, and wherein said plurality of latch elements are disengaged from said post member when said post member is oriented within said passage and said plurality of latch elements are in said outward position to allow axial movement of said post member in said first axial direction;

a solenoid including, at least, an electric magnet, and an armature movably associated with said electric magnet; and a disengagement member connected to said armature and movable therewith between a first position and a second position, wherein said disengagement member urges said plurality of latch elements into said outward position when said disengagement member is in said first position.

13. The latching apparatus of claim 12, wherein, when said post member is inserted into said passage, said plurality of latch elements contact said disengagement member to force said disengagement member into said second position.

14. The latching apparatus of claim 12, wherein said armature extends into said passage in a direction defined from said second end of said housing member toward said first end of said housing member.

15. The latching apparatus of claim 12, wherein said post member defines an elongated post axis, and wherein said first end of said post member is connected to the first body such that said post member is incapable of substantially rotating angularly about said post axis.

16. The latching apparatus of claim 12, wherein said post member defines a post axis and includes, at least, a post surface defining at least one radial distance from said post axis, wherein said plurality of latch elements engage said post surface, a first end, wherein said first end of said post member is connected to the first body, and a second end, wherein said post axis extends in a direction defined from said first end of said post member to said second end of said post member, and wherein said second end of said post member defines an aperture for receiving said disengagement member when said post member is oriented within said passage and said disengagement member is in said first position.

17. The latching apparatus of claim 16, wherein said first end of said post member is connected to the first body such that said post member is incapable of substantially rotating angularly about said post axis.

18. The latching apparatus of claim 16, wherein said post surface defines a plurality of protrusions for interacting with said plurality of latch elements.

19. A method of gripping and releasing a post comprising the steps of:

moving a post element in a first direction into engagement with a latch element to effect a grip on the post; and moving an insert member in a second direction that is generally opposite from the first direction to insert the insert member between the latch element and the post to release the grip on the post.

20. The method of claim 19, wherein that method further comprises the step of providing a plurality of latch elements that are oriented to define a passage therebetween, wherein the passage defines an axis and a first end and a second end, wherein the step of moving the post element includes, at least, inserting the post through the first end of the passage and into the passage, wherein the plurality of latch elements are movable between an outward position and inward position closer to the axis, wherein the plurality of latch elements engage the post when the post is oriented within passage and the plurality of latch elements are in the inward position to restrict axial movement of the post member in at least a first axial direction, and wherein the plurality of latch elements cooperate with the post when the post is oriented within said passage and the plurality of latch elements are in the outward position to allow axial movement of the post member in the first axial direction, and wherein the step of moving the insert member includes, at least, moving the insert member in a direction defined from the second end of the passage toward the first end of the passage to insert the insert member between the plurality of latch elements.

21. The method of claim 20, further comprising the step of biasing the plurality of latch elements toward the inward position.

22. The method of claim 20, further comprising the step of moving the insert member away from the plurality of latch elements including, at least, inserting the post into the passage to move the insert member with respect to the plurality of latch elements, moving a latch element of the plurality of latch elements into contact with the insert member such that the latch element forces the insert member away from the plurality of latch elements.

23. The latching apparatus of claim 1, wherein the latching apparatus is constructed and arranged such that when said latch element engages said post member said disengagement member is substantially inaccessibly enclosed within a chamber, whereby the security of the latching apparatus is enhanced.

24. The latching apparatus of claim 1, wherein said housing member defines a first end of said passage and an opposite second end of said passage, wherein said post member is inserted into and withdrawn from said first end of said passage, and wherein when said disengagement member moves from said second position toward said first position, said disengagement member moves in a direction defined from said second end of said passage toward said first end of said passage.

25. The latching apparatus of claim 1, wherein the latching apparatus is constructed and arranged such that said disengagement member is generally inseparable from said housing member when said latch element engages said post member.

26. The latching apparatus of claim 1, further comprising a door, wherein said post member is connected to said door, and a frame, wherein said housing member is connected to said frame such that said door is latched to said frame when said latch engages said post member.

27. The latching apparatus of claim 1, wherein the latching apparatus is constructed and arranged such that said disengagement member is connected to said housing member when said post member is withdrawn from said housing member.

28. The latching apparatus of claim 1, wherein the latching apparatus is constructed and arranged such that said disengagement member is maintained in contact with said latch element when said post member is withdrawn from said housing.

29. The method of claim 19, wherein the insert member is linked to an electric solenoid, and wherein the step of moving the insert member includes a step of actuating the electric solenoid so that the electric solenoid moves the insert member.

* * * * *